United States Patent [19]

Martin

[11] Patent Number: 4,611,840

[45] Date of Patent: Sep. 16, 1986

[54] DOOR CONTROL MECHANISM

[76] Inventor: Frank J. Martin, 2240 Gale Rd., Ann Arbor, Mich. 48105

[21] Appl. No.: 594,045

[22] Filed: Mar. 28, 1984

[51] Int. Cl.[4] ..... E05C 1/02

[52] U.S. Cl. ..... 292/177; 292/DIG. 66; 292/337

[58] Field of Search ..... 292/177–182, 292/139, 152, 167, 168, 137, 138, 145, 147, 149, DIG. 66, 337

[56] References Cited

U.S. PATENT DOCUMENTS

| | | | |
|---|---|---|---|
| 1,394,962 | 10/1921 | Bate | 292/167 |
| 2,062,176 | 11/1936 | Hennigan | 292/138 X |
| 2,202,916 | 6/1940 | Mussa | 292/179 X |
| 2,459,571 | 1/1949 | Mihalek et al. | 292/182 X |
| 4,005,886 | 2/1977 | Lirette | 292/21 X |
| 4,157,197 | 6/1979 | Wilson | 292/180 X |
| 4,445,717 | 5/1984 | Imhoff | 292/DIG. 66 |

*Primary Examiner*—Richard E. Moore
*Attorney, Agent, or Firm*—Stephenson & Boller

[57] ABSTRACT

A door control mechanism for use in conjunction with a pair of swinging doors to control latching. The mechanism comprises a first stamped metal part adapted to be fixedly mounted on the door. This part comprises a first track portion and a second track portion. A second stamped metal part comprises a slide portion which slidably engages one track portion of the first metal part. An actuating mechanism is arranged on the second track portion of the first stamped metal part and has an operative coupling with the second stamped metal part. The second stamped metal part is adapted to be connected to a latch bolt. When the actuating mechanism is operated, the second stamped metal part is selectively positioned along the first track portion of the first stamped metal part with the bolt being positioned accordingly.

17 Claims, 8 Drawing Figures

DOOR CONTROL MECHANISM

BACKGROUND AND SUMMARY OF THE INVENTION

This invention relates to door control mechanisms, particularly a mechanism for use with one of a pair of swinging doors which close together along a common line of closure.

A door control mechanism of the general type to which the present invention relates is shown in U.S. Pat. No. 4,005,886, dated Feb. 1, 1977. The door control mechanism disclosed in that patent is operable to control a latching member in one of the doors. The door control mechanism is spring-biased to a condition in which the latching member is in its non-latching position allowing the particular door to swing. When that door is in the closed position and the other door is open, a cam actuator of the door control mechanism projects from the one door so as to be disposed for striking by the other door upon closing. When struck by the other door, the cam actuator is displaced to actuate the door control mechanism such that the latching member is operated to its latching position where it projects from the one door into engagement with structure forming the door opening within which the doors are disposed. Accordingly, the door which contains the door control mechanism is thereby automatically latched to the frame in response to closing of the other swinging door.

The door control mechanism disclosed in that patent comprises a flush mounting member which supports a slide. That member is a casting which requires various machining operations for completion. Round holes are provided in the member to guide a cylindrical rod forming the slide. The slide is coupled to the latching member and is operated by the actuating mechanism including the cam actuator referred to above.

The present invention is directed to improvements which significantly render a more cost-effective door control mechanism of this type. The present invention in a preferred embodiment comprises a construction made predominantly of stamped metal parts.

By using stamped metal parts, various machining operations on metal castings can be eliminated, and this contributes significantly to the cost-effectiveness of such a door control mechanism. The construction is such that the number of individual component parts can be reduced and the mechanism fabricated with more convenient procedures.

Door control mechanisms of the general type of which the present invention relates may be any of several different kinds. The present application discloses two such kinds, and they possess a significant commonality of parts, a further benefit of the invention.

The foregoing features, advantages and benefits of the invention along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
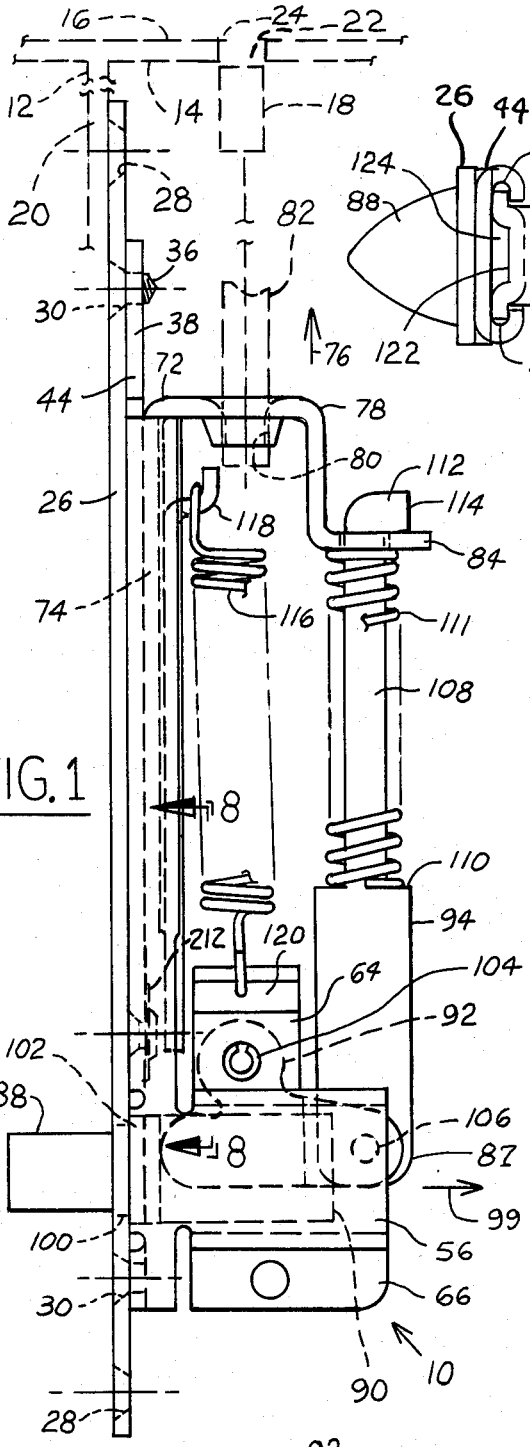
FIG. 1 is an elevational view of a preferred embodiment of one kind of door control mechanism according to the present invention, and includes a schematic illustration of intended operative association with a pair of swinging doors.

FIG. 1 illustrates a first embodiment 10 of door control mechanism embodying principles of the present invention. Shown schematically in fragmentary form in association with door control mechanism 10 are a pair of swinging doors 12 and 14 which are disposed within a door frame opening 16. Mechanism 10 is mounted on door 14, and that door includes a latch bolt 18 which is controlled by mechanism 10. Doors 12 and 14 are hinged respectively along opposite vertical sides of door frame opening 16 so as to swing about respective parallel vertical axes. When the doors are in the closed position within opening 16 as illustrated, they come together along an imaginary common line of closure 20.

Suitable apertures 22 and 24 are provided in door 14 and frame 16 as illustrated to provide for the latching of door 14 to frame 16 by means of bolt 18 when door 14 is closed. FIG. 1 illustrates bolt 18 in the unlatched condition. Latching is effected by operation of door control mechanism 10 to cause bolt 18 to be displaced upwardly from the position illustrated in FIG. 1 to pass through apertures 22 and 24. As will be seen in the ensuing description, bolt 18 is normally biased to the unlatched position illustrated in FIG. 1 but is operated to latch door 14 to frame 16 in response to the closure of door 12.

Door control mechanism 10 mounts along the vertical side edge of door 14 which defines one side of the imaginary common line of closure 20. The door is provided with a suitable interior construction to accommodate the door control mechanism and the operative coupling thereof to bolt 18.

Mounting of the door control mechanism on the door is accomplished by means of a flush mounting plate 26. Flush mounting plate 26 is illustrated as a flat, rectangular, stamped metal part which is provided with four countersink holes 28 at the four corners. The door has a rectangular shaped recess to receive flush mounting plate 26. Fasteners (not shown) such as headed screws are passed through holes 28 and into the door to secure attachment.

A pair of further countersink holes 30 in plate 26 provide for the attachment of a stamped metal member 38. The attachment is accomplished by means of headed screws 36 which are passed through holes 30 to threadedly engage holes 37 in member 38.

Member 38 may be considered as comprising a flat, generally rectangularly shaped mounting portion 44 which is disposed flat against flush mounting plate 26.

Figure 2:
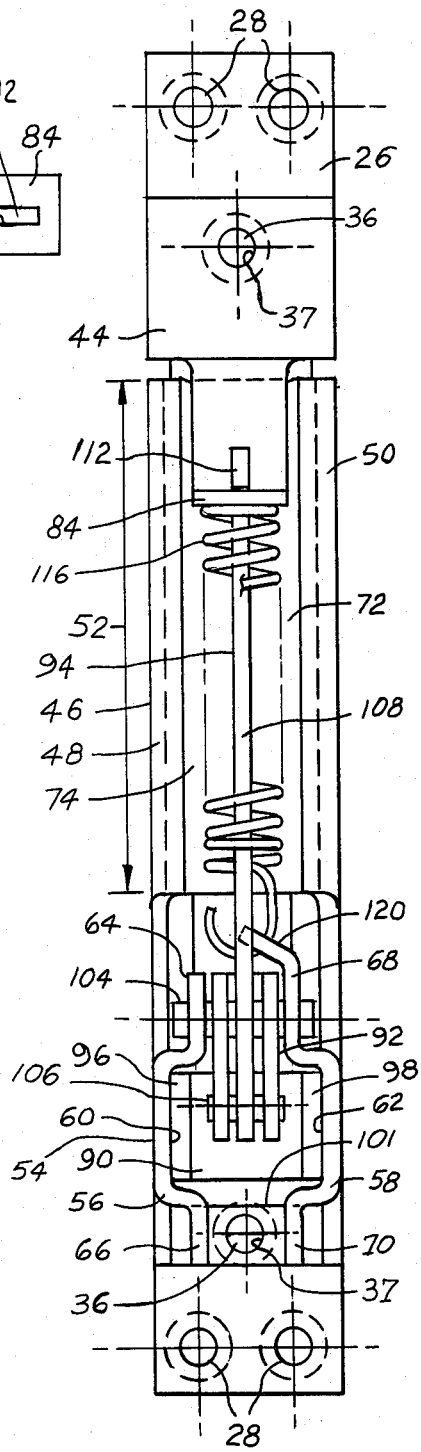
FIG. 2 is a right elevational view of the door control mechanism of FIG. 1.

This mounting portion 44 has a width corresponding essentially to the width of flush mounting plate 26 as can be seen in FIG. 2. Its length is however somewhat shorter than the length of flush mounting plate 26.

Member 38 further comprises a track portion 46 which is provided by portions of the longitudinal side edges of member 38 being reverse turned inwardly essentially 180° so as to thereby define a pair of longitudinally extending slots 48 and 50 which are open toward each other across the width of member 38. The two slots have a longitudinal extent indicated by the reference numral 52 in FIG. 2, and the longitudinal ends of the slots are open.

Member 38 is still further provided with a second track portion 54 which is located below track portion 46. Track portion 54 is defined by sides 56, 58 which extend at a right angle from mounting portion 44. As can be seen from consideration of FIG. 2, sides 56, 58 are shaped to define slots 60, 62 respectively which are open toward each other. The length of second track portion 54 is at 90° to the length of the first track portion 46.

It will further be observed that sides 56 and 58 are provided with respective flanges, 64 and 66 in the case of side 54, and 68 and 70 in the case of side 58. These flanges project away from the respective slots 60 and 62.

Door control mechanism 10 comprises another stamped metal part 72 which has a cooperative association with first track portion 46. The cooperative association is provided by member 72 comprising a generally rectangular shaped slide portion 74. The width of slide portion 74 is such that its longitudinal side edges fit within slots 48 and 50 with a close sliding fit. Track portion 46 thereby guides member 72 for vertical displacement, as in the direction of the arrow 76 from the position illustrated in FIG. 1. Because the upper longitudinal ends of slots 48 and 50 are open, member 72 can be cooperatively associated with first track portion 46 by inserting the lower end of slide portion 74 into the upper ends of the slots.

Member 72 is provided with an arm portion 78 which extends generally transversely from slide portion 74 at the upper end thereof. Arm portion 78 comprises a pierced and tapped hole 80 adjacent slide portion 74. Hole 80 is intended to receive the lower threaded end of a connecting rod 82 via which member 72 is connected to bolt 18.

Arm portion 78 comprises a distal end 84 which is downwardly offset from the proximal portion of the arm which contains hole 80. Distal end 84 has a rectangularly shaped hole 86 which provides for operative connection with an actuating mechanism, generally 87.

Actuating mechanism 87 includes a cam element 88, an actuating element 90, a crank 92, and a link 94.

Actuating element 90 is a stamped U-shaped part having sides 96, 98 which fit slideably within slots 60 and 62 respectively, so as to provide for the transverse displacement of element 90 along track portion 54, as in the direction indicated by the arrow 99 from the position shown in FIG. 1.

Figure 4:
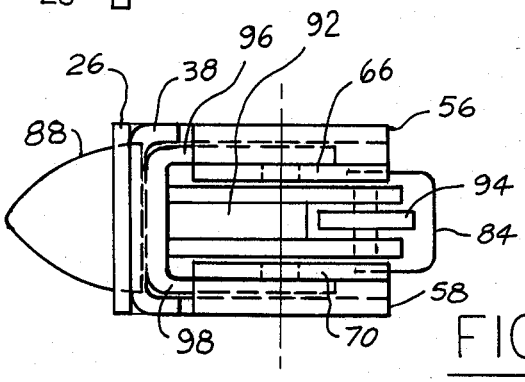
FIG. 4 is a bottom view of the door control mechanism shown in FIG. 1.

Cam element 88 has a generally triangular shape and projects through rectangular shaped openings 100, 101 in flush mounting plate 26 and member 38 respectively such that the apex of the triangle points away from flush mounting plate 26. The opening 101 in member 38 is greater in height than opening 100 in flush mounting plate 26. Element 88 includes flanges 102 along the top and bottom edges of the triangle's base which abut flush mounting plate 26 at the top and bottom margins of opening 100. This serves to define a stop limiting the extent to which element 88 can project outwardly from flush mounting plate 26. Flanges 102 are dimensioned such that they can slide within slots 60 and 62 when element 88 is displaced to the right from the position shown in FIGS. 1 and 4 and hence be effective on the base of element 90 to thereby displace the latter to the right also.

Crank 92 is mounted on member 38 to pivot about a horizontal axis defined by a pivot pin 104. Apertures are provided in flanges 64 and 68. The crank is disposed between the two sides 56, 58 and pin 104 passes through the holes in the flanges and a corresponding hole in the crank. The crank has an arm which is provided with a slotted end spaced from pin 104. One end of link 94 is disposed within this crank arm slot. A pivotal connection is provided between the crank arm and the link by means of a pivot pin 106 passing through aligned holes in the crank arm and link.

Link 94 is a metal part of uniform thickness which is stamped to the shape which appears in FIG. 1. Link 94 comprises a narrower intermediate portion 108 which has a rectangular shaped cross ection. The dimensions of this rectangular shaped cross section portion are such that it can pass through hole 86 in the distal end portion 84 of arm 78. The link is also provided with a shoulder 110, and a helical coil spring 111 is disposed around portion 108 between shoulder 110 and distal end portion 84 of arm 78.

The upper end of link 94 is shaped into a transverse projection 112 which prevents link 94 from disconnecting from arm 78 when the link is displaced downwardly relative to the arm. The projection may be considered as a curved extension of the nominal cross section of portion 108. The shape of projection 112 is hence such that the link can be assembled to the arm without the use of any separate fasteners during fabrication of the door control mechanism. The connection of link 94 to arm portion 78 is accomplished by first positioning the link approximately 90° counterclockwise from what is shown in FIG. 1 so as to align the end face 114 of projection 112 with aperture 86. The projection is passed through hole 86 as the link is swung in the clockwise direction to bring it to the position of FIG. 1. Spring 111 is pre-assembled onto the link and when the link has been brought to the final position it is connected to crank 92 by insertion of pin 106, the crank being suitably positioned so as to allow for insertion of the pin between the crank arm and the link.

Member 72 and actuating mechanism 87 are biased to the position illustrated in the drawing figures by means of a helical coil spring 116. One end of coil spring 116 is secured to member 38 while the other end is secured to member 72 such that member 72 is biased in the downward direction relative to member 38.

The construction provides a particularly convenient connection of spring 116. A hook 118 is lanced from the slide portion of member 72 just below arm 78. One end of spring 116 is hooked onto this lanced hook. The opposite end of the spring is hooked through a small hole in a distal end portion 120 of flange 68.

It will be appreciated that when member 72 is displaced upwardly in the direction of arrow 76 from the position illustrated in FIG. 1, spring 116 exerts a downward force tending to urge the member downwardly. Hence, in its free condition, the door control mechanism assumes the position illustrated in the drawing figures with arm 78 abutting the upper ends of slots 48, 50, so that the mechanism biases bolt 18 to the unlatched condition.

When door 14 is in the closed condition and the opposite door 12 is closed, the latter door will strike cam element 88. The shape of element 88 is such that striking is permissible from either side. The striking action is effective to displace element 88 inwardly and this inward displacement in turn results in the U-shaped element 90 being displaced inwardly along track portion 54. The base of element 90 acts on crank 92 to cause the crank to pivot in the counterclockwise direction as viewed in FIG. 1 resulting in upward displacement of link 94.

Spring 111 is relatively stiff in comparison to the total of the other forces resisting upward displacement of the link. Accordingly, essentially the full upward displacement of the link is imparted to member 72. This operates bolt 18 to the latched position.

When door 12 is opened, spring 116 is effective to return the mechanism to the position shown in the drawing figures and thereby unlatch bolt 18.

Figure 3:
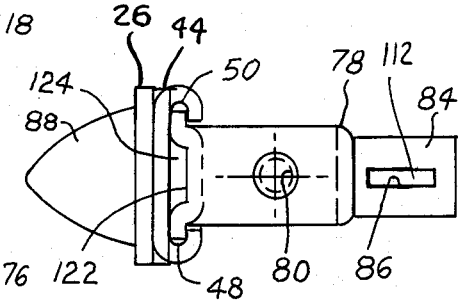
FIG. 3 is a top plan view of the door control mechanism shown in FIG. 1.

It will be observed that the slide portion of member 72 is provided with an indented or offset central region 122 (FIG. 3) between its longitudinal side edges which fit in slots 48 and 50. This provides a space 124 for clearance of any protrusion of the shank of the upper screw 36 when the member 72 is displaced.

Figure 5:
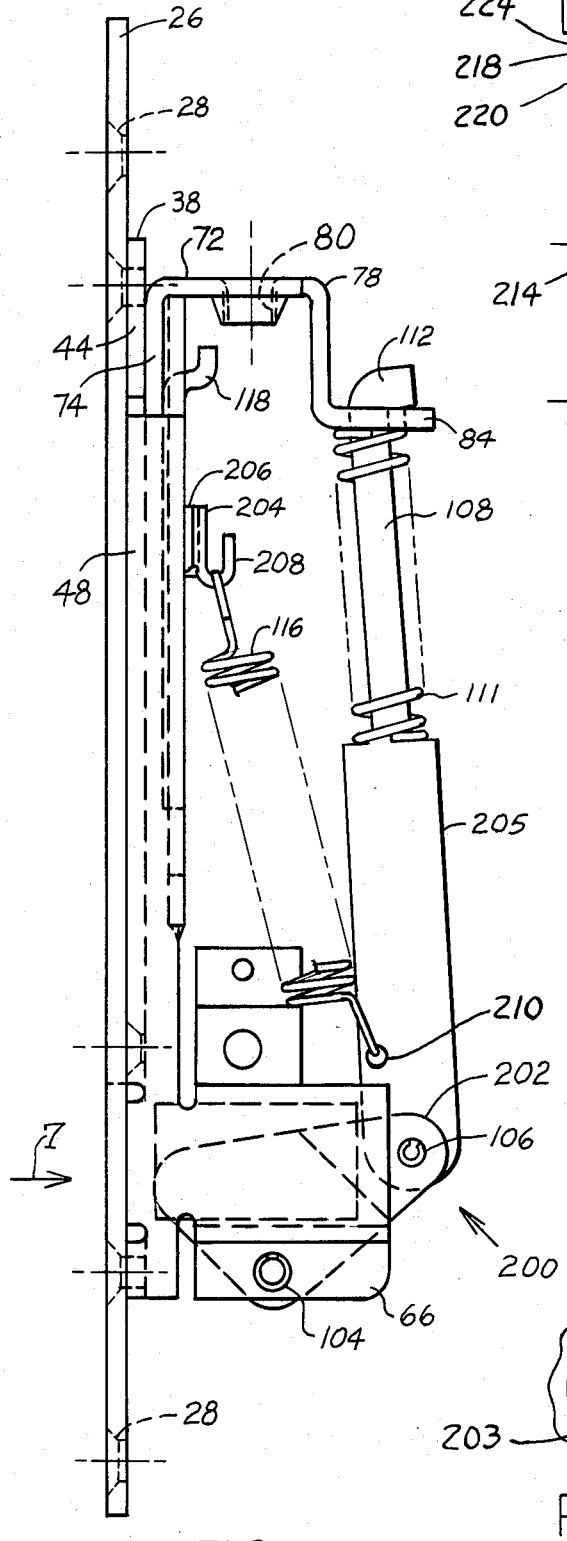
FIG. 5 is an elevational view of a preferred embodiment of another kind of door control mechanism embodying principles of the present invention.
Figure 7:
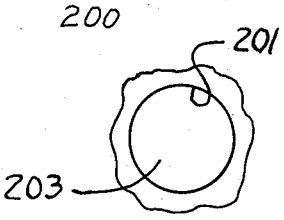
FIG. 7 is a fragmentary view taken in the direction of arrow 7 in FIG. 5.
Figure 6:
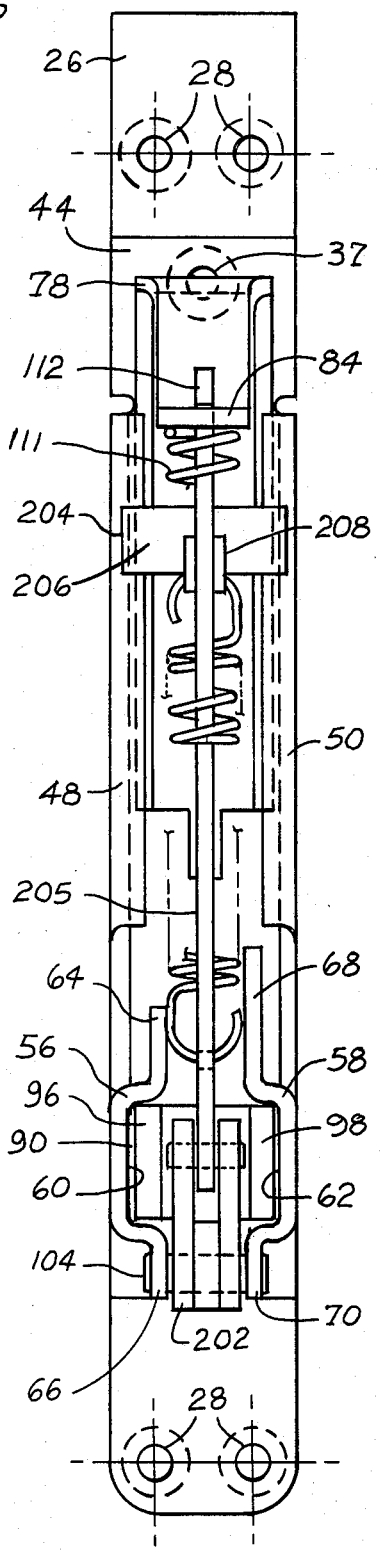
FIG. 6 is a right elevational view of FIG. 5.

FIGS. 5, 6, and 7 illustrate a further embodiment 200 of door control mechanism embodying principles of the present invention. This embodiment is of a configuration which provides a constant latching function. It uses many of the same parts as in embodiment 10, and these are identified by the same reference numerals and will not be described in any further detail except to the extent necessary to describe the differences between the two embodiments.

The cam actuator element 88 is not used in embodiment 200. The opening 100 in the flush mounting plate is replaced by a circular opening 201 (see FIG. 7) for a circular button 203 secured to one end of actuating element 90, and the clearance opening 101 in member 38 is large enough to accommodate the button when the button is depressed. A different crank is also used and is identified by the reference numeral 202. Instead of pivot pin 104 pivoting the crank 202 on the upper flanges of sides 56 and 58, it pivots crank 202 on the lower flanges 66 and 70, these flanges being provided with suitable holes for pin 104. Link 94 is replaced by a link 205 which has the same general shape as link 94 but is of slightly different lengthwise dimensions as will be seen by comparison of the respective drawing figures for the two embodiments.

Spring 116 is arranged to bias bolt 18 toward the latched position (i.e. constant latching). This is accomplished by the inclusion of a hook-containing bracket 204 having a base 206 which is attached to the turned side edge portions of member 38 which form slots 48 and 50. A hook 208 is provided centrally of the bracket for one end of spring 116. The opposite end of spring 116 is hooked through a hole 210 in link 205.

FIGS. 5, 6, and 7 illustrate the position to which the mechanism is biased by spring 116. The abutment of the ends of sides 96, 98 of actuating element 90 with the flush mounting plate around circular opening 201 defines the bias position, and in this position the outer face of button 203 is essentially flush with the outer face of the flush mounting plate. Button 203 does not fully cover the end of actuating element 90 to which it is attached, but rather leaves exposed the upper and lower four corners of that end of the actuating element so that these four corners (i.e. at the upper and lower ends of each side 96, 98) can abut the flush mounting plate at four locations around opening 201 to define the bias position.

When it is desired to unlatch bolt 18 element 90 is displaced to the right in FIG. 5 by pushing button 203 inwardly. The displacement of element 90 to the right causes crank 202 to pivot in a clockwise sense about pin 104. This causes link 205 to be displaced downwardly and the upper end of the link pulls member 72 downwardly. The downward displacement of the member is resisted by spring 116. When the external force on actuating element 90 is released, spring 116 returns the mechanism to the position illustrated in the drawing figures and hence returns bolt 18 to the latched position.

In both embodiments the provision of spring 111 provides for a lost-motion connection which allows member 72 to be displaced downwardly relative to the link member so that member 72 can be operated downwardly to override the link.

Figure 8:
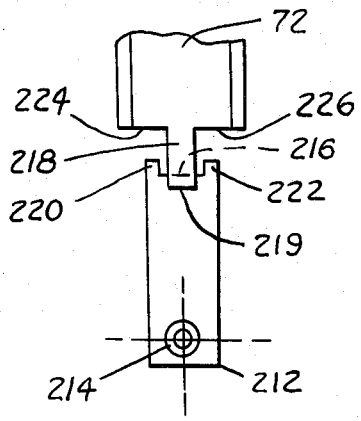
FIG. 8 is a fragmentary view in the direction of arrows 8—8 in FIG. 1 but showing a different operative position.

FIGS. 1 and 8 illustrate detail of a bi-metal element 212 incorporated into the embodiment of mechanism 10. The purpose of bi-metal element 212 is to prevent, or at least delay, unlatching of a latched door in the event of a fire. Doors with which door control mechanisms are customarily used may be required to function as fire doors, and in that regard measures may be required to maintain them closed in the event of fire.

Bi-metal element 212, in the normal range of temperatures, assumes a flat condition wherein it is disposed essentially flat against the surface of mounting portion 44 which faces toward link 94. The bi-metal is located as shown with its lower end secured to member 38 by means of a rivet 214. Bi-metal element 212 has a generally rectangular overall shape except for a rectangular shaped slot 216 being centrally provided in its upper edge.

When mechanism 10 is in the non-latched position illustrated in FIG. 1, slide portion 74 of part 72 overlies a substantial part of the bi-metal element.

When the mechanism 10 is operated to the latching position, the position of the lower end of slide portion 74 in relation to the upper end of bimetal element 212 is as shown in FIG. 8. The lower end of slide portion 74 is provided with a centrally depending rectangular tongue 218 which is narrower in width than slot 216. It will be observed however that the distal end 219 of tongue 218 extends downwardly beyond slot 216 so as to overlie part of the main body of bi-metal element 212 below slot 216.

In the event of fire, the elevated temperatures cause bi-metal element 212 to flex, and since its lower end is riveted against the part 38, the upper end will warp outwardly away from mounting portion 44. When this happens, projections 220, 222 of the bi-metal element to each side of slot 216 will be an interference with the downward travel of part 72. Hence, if there is a fire condition which would tend to cause the latch bolt to be displaced downwardly to where it might become unlatched, the downward movement will be prevented by abutment of the edge portions 224, 226 of part 72 with projections 220, 222.

The overlap provided by the distal end of the tongue with the main body of the bi-metal when the mechanism is in the latched condition limits the extent to which the bi-metal can flex so that it guards against a condition whereby the bi-metal might flex too much to where the slide could drop in behind the overflexed bi-metal and thereby permit the door to become unlatched.

It can be appreciated that this particular arrangement for the bi-metal provides an advantageous contribution to the overall construction since all that is required is the riveting of the bi-metal part to the existing stamped metal part.

When the mechanism is operated to the unlatched condition, the slide edge portions 224, 226 are disposed below the upper edges 220, 222 of the bi-metal so that flexing of the bi-metal in this condition would be limited by the overlying slide portion, and it would be possible to operate the mechanism to the latched position, at least insofar as the bi-metal would not prevent the upward displacement of the slide portion.

The foregoing has disclosed and described a novel improvement in a door control mechanism which provides for a more convenient and cost-effective manufacture. The formation of the stamped parts is accomplished by conventional procedures and equipment.

While a preferred embodiment of the invention has been disclosed, it will be appreciated that other embodiments may be fabricated using principles of the invention as claimed herein.

What is claimed is:

1. For use in conjunction with a pair of swinging doors mounted within a door frame opening wherein the doors have edges which come together along a common line of closure when the doors are closed, a door control mechanism adapted for mounting along the edge of one of the doors to control a latching means associated with the one door for selectively latching the one door within the door frame opening, said door control mechanism comprising first and second stamped metal members, said first stamped metal member comprising a track portion, said first member being adapted to be mounted along the edge of the one door so that the length of said track portion is parallel with that edge, said second stamped metal member comprising a slide portion adapted for connection to the latching means of the one door, said slide portion being engaged with said track portion such that said second member is guided on said first member for displacement lengthwise of said track portion, and an actuating mechanism operatively coupled with said second member for displacing said second member along said track portion, said second member comprising an arm portion projecting generally transversely of its slide portion, said actuating mechanism having an operative coupling with said arm portion for displacing said second member along said track portion, said arm portion adapted to provide for operative connection of said second member with the latching means of the one door, said actuating mechanism comprising an actuating element, means for guiding said actuating element relative to said first member for displacement in a direction which is transverse to the direction of displacement of said second member on said first member, a crank disposed for operation by said actuating element, and a third stamped metal member in the form of a link operatively coupling said crank and said arm portion of said second member, said arm portion having an aperture through which said link passes, said link having a main portion between said arm portion and said crank, said main portion having a lost-motion fit through said aperture, said link having an end portion disposed beyond said aperture relative to said crank, means on said end portion having a shape which interferes with said aperture to thereby define one end limit for the lost-motion fit with said aperture, and spring bias means acting on said actuating mechanism relative to said second member to spring bias said means on said end portion into interference with said aperture and hence said link to the one end limit of the lost-motion fit with said aperture.

2. A door control mechanism as set forth in claim 1 in which said first member comprises a mounting portion having longitudinal side edge portions reverse turned inwardly so as to form said track portion as longitudinally extending slots which are open toward each other, said slide portion of said second member having longitudinally extending side edges which slide within said slots.

3. For use in conjunction with a pair of swinging doors mounted within a door frame opening wherein the doors have edges which come together along a common line of closure when the doors are closed, a door control mechanism adapted for mounting along the edge of one of the doors to control a latching means associated with the one door for selectively latching the one door within the door frame opening, said door control mechanism comprising first and second stamped metal members, said first stamped metal member comprising a track portion, said first member being adapted to be mounted along the edge of the one door so that the length of said track portion is parallel with that edge, said second stamped metal member comprising a slide portion adapted for connection to the latching means of the one door, said slide portion being engaged with said track portion such that said second member is guided on said first member for displacement lengthwise of said track portion, and an actuating mechanism operatively coupled with said second member for displacing said second member along said track portion, said first member comprising a mounting portion, longitudinal side edge portions of said mounting portion being reverse turned inwardly so as to form said track portion as longitudinally extending slots which are open toward each other, said mounting portion containing an aperture adapted to receive a fastening means forming a portion of the mounting of said first member along the edge of the one door and said slide portion of said second member passing over said aperture during displacement of said second member along said track portion, said slide portion of said second member having longitudinally extending side edges which slide within said slots, said slide portion having a central region between its longitudinally extending side edges, said central region being indented relative to said slide portion's longitudinally extending side edges so as to form a channel-shaped cross section which in cooperation with said mounting portion of said first member defines a space between said central region of said second member and said mounting portion of said first member so that when said slide portion passes over said aperture, said central region is spaced from said aperture and hence is adapted to clear a fastening means received in said aperture.

4. A door control mechanism as set forth in claim 1 in which said aperture comprises a rectangular hole, said link's main portion having a lost-motion fit with said aperture being provided with a cross sectional shape similar to that of, and passing through, said hole and said means on said end portion of said link having a cross sectional shape which differs from the cross sectional shape of the portion passing through said hole.

5. A door control mechanism as set forth in claim 4 in which said link includes a shoulder and said spring bias means comprises a helical coil spring disposed around said link between said shoulder and said arm portion.

6. For use in conjunction with a pair of swinging doors mounted within a door frame opening wherein the doors have edges which come together along a common line of closure when the doors are closed, a door control mechanism adapted for mounting along the edge of one of the doors to control a latching means associated with the one door for selectively latching the one door within the door frame opening, said door control mechanism comprising first and second stamped metal members, said first stamped metal member comprising a track portion, said first member being adapted to be mounted along the edge of the one door so that the length of said track portion is parallel with that edge, said second stamped metal member comprising a slide portion adapted for connection to the latching means of the one door, said slide portion being engaged with said track portion such that said second member is guided on said first member for displacement lengthwise of said track portion, and an actuating mechanism operatively coupled with said second member for displacing said second member along said track portion, wherein said second member comprises an arm portion projecting generally transversely of its slide portion, said actuating mechanism having an operative coupling with said arm portion for displacing said second member along said track portion, said arm portion adapted to provide for operative connection of said second member with the latching means of the one door, an aperture in said arm portion, said door control mechanism comprising a third stamped metal member in the form of a link which is a part of said actuating mechanism, said link passing through said aperture and having a shape which prevents disengagement of its operative coupling with said arm portion during displacement of said second member by said actuating mechanism, said aperture comprising a rectangular hole, said link having a portion provided with a cross sectional shape similar to that of, and passing through, said hole and said link having a further portion with a cross sectional shape which differs from the cross sectional shape of the portion passing through said hole so as to prevent disengagement from said arm portion, said link including a shoulder and further including a helical coil spring disposed around said link between said shoulder and said arm portion to provide for a lost-motion connection between said link and said arm portion when said arm portion is displaced in a direction lengthwise of said link away from said further portion of said link, and in which said actuating mechanism comprises a crank pivotally mounted on said first member, said crank having a crank arm operatively coupled with said link, an actuating element operatively coupled with said crank, said actuating element comprising a stamped U-shaped part which is slidably mounted on said first member for displacement in a direction which is transverse to the direction of displacement of said second member on said first member, the displacement of said U-shaped part on said first member operating said crank.

7. For use in conjunction with a pair of swinging doors mounted within a door frame opening wherein the doors have edges which come together along a common line of closure when the doors are closed, a door control mechanism adapted from mounting along the edge of one of the doors to control a latching means associated with the one door for selectively latching the one door within the door frame opening, said door control mechanism comprising first and second stamped metal members, said first stamped metal member comprising a track portion, said first member being adapted to be mounted along the edge of the one door so that the length of said track portion is parallel with that edge, said second stamped metal member comprising a slide portion adapted for connection to the latching means of the one door, said slide portion being engaged with said track portion such that said second member is guided on said first member for displacement lengthwise of said track portion, and an actuating mechanism operatively coupled with said second member for displacing said second member along said track portion, said first member comprising a second track portion disposed generally at a right angle to the length of the first-mentioned track portion, said actuating mechanism comprising an actuating element which is displaceable along said second track portion and a coupling from said actuating element to said second member.

8. A door control mechanism as set forth in claim 7 in which said coupling from said actuating element to said second member comprises a crank pivotally mounted on said first member, said crank having a crank arm and a link connecting said crank arm to said second member.

9. A door control mechanism as set forth in claim 7 in which said actuating element comprises a stamped metal part having a general U-shape whose sides slide within respective sides of said second track portion.

10. For use in conjunction with a pair of swinging doors mounted within a door frame opening wherein the doors have edges which come together along a common line of closure when the doors are closed, a door control mechanism adapted for mounting along the edge of one of the doors to control a latching means associated with the one door for selectively latching the one door within the door frame opening, said door control mechanism comprising first and second stamped metal members, said first stamped metal member comprising a track portion, said first member being adapted to be mounted along the edge of the one door so that the length of said track portion is parallel with that edge, said second stamped metal member comprising a slide portion adapted for connection to the latching means of the one door, said slide portion being engaged with said track portion such that said second member is guided on said first member for displacement lengthwise of said track portion, and an actuating mechanism operatively coupled with said second member for displacing said second member along said track portion, said first member comprising a generally flat mounting portion with said track portion being provided by longitudinal side edge portions of said mounting portion being reverse turned inwardly to form longitudinally extending slots facing each other, said track portion having longitudinal side edges disposed within said slots, said first member comprising a second track portion disposed such that the length thereof is transverse to the length of said first track portion, said second track portion comprising spaced apart side portions extending away from the longitudinal side edge portions of said mounting portion, said actuating mechanism comprising an actuator element slidably arranged within said side portions of said second track portion and operatively coupled with said second member such that operation of said actuator element along said second track portion operates said second member.

11. A door control mechanism as set forth in claim 10 in which said actuating mechanism further comprises a crank pivotally mounted on said second track portion and being disposed between said side portions of said second track portion for operation by said actuator element, said crank having an arm which is operatively coupled with said second member.

12. A door control mechanism as set forth in claim 11 in which said crank arm is operatively coupled with said second member by a stamped metal link and in which said actuator element comprises a stamped U-shaped element in which the sides of the U-shaped element slide within said side portions of said second track portion, said crank arm being disposed between the sides of said U-shaped element.

13. A stamped metal member for use as a track portion of a door control mechanism, said member comprising a generally flat mounting portion, a pair of track portions, one of said track portions comprising the sides of said generally flat mounting member being reverse turned inwardly to form longitudinally extending slots which are open toward each other along a portion of the length of said member and the other of said track portions comprising side portions extending away from said mounting portion at a right angle to the length of said slots, said stamped metal member being in combination with a second stamped metal member, said second stamped metal member comprising a slide portion slidably engaged with said one track portion of the first-mentioned member, said second member having an arm portion projecting from said slide portion at one end thereof so as to be exterior of said one track portion, and an actuating mechanism comprising a slide element within said other track portion and an operative coupling from said slide element to said arm portion, said operative coupling including a stamped metal link.

14. A door control mechanism as set forth in claim 2 in which said slide portion has a central region between its longitudinally extending side edges, said central region being indented relative to said slide portion's longitudinally extending side edges so as to provide a space between said central region of said second member and said mounting portion of said first member.

15. For use in conjunction with a pair of swinging doors mounted within a door frame opening wherein the doors have edges which come together along a common line of closure when the doors are closed, a door control mechanism adapted for mounting along the edge of one of the doors to control a latching means associated with the one door for selectively latching the one door within the door frame opening, said door control mechanism comprising a pair of stamped metal track portions, one of said stamped metal track portions adapted to be mounted along the edge of the one door so that the length of said one stamped metal track portion is parallel with that edge and the other of said stamped metal track portions extending away from said one stamped metal track portion at a right angle thereto, each track portion comprising marginal edge portions being reverse turned inwardly to form respective slots which are open toward each other, a stamped metal slide member slidably engaged with the slots of said one stamped metal track portion, an arm portion projecting from said stamped metal slide member so as to be exterior of said one track portion, an actuating mechanism comprising a slide element slidably engaged with the slots of said other stamped metal track portion, and an operative coupling from said slide member to said arm portion, said operative coupling including a stamped metal link.

16. A door control mechanism as set forth in claim 15 in which said arm portion and said slide member are portions of a single metal stamping.

17. A door control mechanism as set forth in claim 15 in which said two stamped metal track portions are portions of a single metal stamping.

* * * * *